US006058952A

United States Patent [19]

Lin et al.

[11] Patent Number: 6,058,952

[45] Date of Patent: May 9, 2000

[54] SIMPLIFIED FLAT TOP UMBRELLA

[75] Inventors: Chung-Kuang Lin, Taipei; Jung-Jen Chang, Taipei Hsien, both of Taiwan

[73] Assignees: Fu Tai Umbrella Works, Ltd.; Louis Sammarco, both of Taipei Hsien, Taiwan

[21] Appl. No.: 09/204,755

[22] Filed: Dec. 2, 1998

[51] Int. Cl.[7] ..... A45B 25/02

[52] U.S. Cl. ..... 135/29; 135/23; 135/31; 135/32; 135/27

[58] Field of Search ..... 135/23, 29, 31, 135/32, 37, 33.2, 25.3, 20.1, 27

[56] References Cited

U.S. PATENT DOCUMENTS

| | | | |
|---|---|---|---|
| 1,096,647 | 5/1914 | Stein | 135/29 X |
| 1,156,709 | 10/1915 | Rose | 135/31 X |
| 2,788,792 | 4/1957 | Koller | 135/31 X |
| 3,902,514 | 9/1975 | Weber | 135/32 X |
| 5,121,764 | 6/1992 | Wu | 135/31 |
| 5,193,565 | 3/1993 | Huang | 135/29 X |
| 5,213,123 | 5/1993 | Whitfield | 135/27 |
| 5,355,903 | 10/1994 | Haddad et al. | 135/29 X |
| 5,479,954 | 1/1996 | Lin | 135/98 |
| 5,787,912 | 8/1998 | Wu | 135/29 |
| 5,878,763 | 3/1999 | Tsai | 135/30 X |

*Primary Examiner*—Carl D. Friedman
*Assistant Examiner*—Winnie Yip

[57] ABSTRACT

A simplified flat top umbrella includes: a central shaft (1) having an upper notch (11) formed on an upper portion of the shaft (1) and a lower runner (12) slidably held on the shaft (1), a top rib (2) pivotally secured to the upper notch (11), an outer rib (3) fixed to the top rib (2), a stretcher rib (4) pivotally connected between the lower runner (12) and the top rib (2), and a pulling rib (5) secured between the stretcher rib (4) and an outer portion (32) of the outer rib (3); whereby upon extending of the ribs having an umbrella cloth retained thereon for opening the umbrella, the top rib (2) and the outer rib (3) will be lifted to form a generally horizontal canopy and the outer portion (32) of the outer rib (3) will be pulled inwardly by the pulling rib (5) and the stretcher rib (4) to form a skirt portion generally perpendicular to the horizontal canopy, thereby providing a light compact flat top umbrella for a convenient carrying and operation.

8 Claims, 4 Drawing Sheets

SIMPLIFIED FLAT TOP UMBRELLA

BACKGROUND OF THE INVENTION

U.S. Pat. No. 5,213,123 to John Whitfield disclosed a flat top umbrella comprising a foldable frame and a web provided having a substantially circular central portion and a substantially annular skirt portion continuous with the central portion.

However, such a conventional flat top umbrella has the following drawbacks:

1. The frame assembly (22) for fastening the web (20) consists of many ribs, stretcher arms, coupling members and tensile elements, thereby increasing the assembly complexity and production cost.
2. The elongate ribs 34 should be strong enough to support the web and the umbrella structure. If the ribs 34 are made of steel material as popularly used in a conventional umbrella, the whole umbrella will be very heavy since there may be twenty-one ribs 34 in practical production, thereby being heavy, clumsy and inconvenient for carrying purpose.
3. The tensile elements (46) and string-like elements (47) as provided in the frame assembly (22) may tangle or influence the folding or unfolding operation of the umbrella.
4. No restoring mechanism is provided to facilitate the folding of an opened umbrella, causing a slow folding action when closing the umbrella from an opened state.

The present inventor has found the drawbacks of the conventional flat top umbrella and invented the simplified flat top umbrella having a light compact rib assembly.

SUMMARY OF THE INVENTION

The object of the present invention is to provide a simplified flat top umbrella including: a central shaft (1) having an upper notch (11) formed on an upper portion of the shaft (1) and a lower runner (12) slidably held on the shaft (1), a top rib (2) pivotally secured to the upper notch (11), an outer rib (3) fixed to the top rib (2), a stretcher rib (4) pivotally connected between the lower runner (12) and the top rib (2), and a pulling rib (5) secured between the stretcher rib (4) and an outer portion (32) of the outer rib (3); whereby upon extending of the ribs having an umbrella cloth retained thereon for opening the umbrella, the top rib (2) and the outer rib (3) will be lifted to form a generally horizontal canopy and the outer portion (32) of the outer rib (3) will be pulled inwardly by the pulling rib (5) and the stretcher rib (4) to form a skirt portion generally perpendicular to the horizontal canopy, thereby providing a light compact flat top umbrella for a convenient carrying and operation.

DETAILED DESCRIPTION

Figure 1:
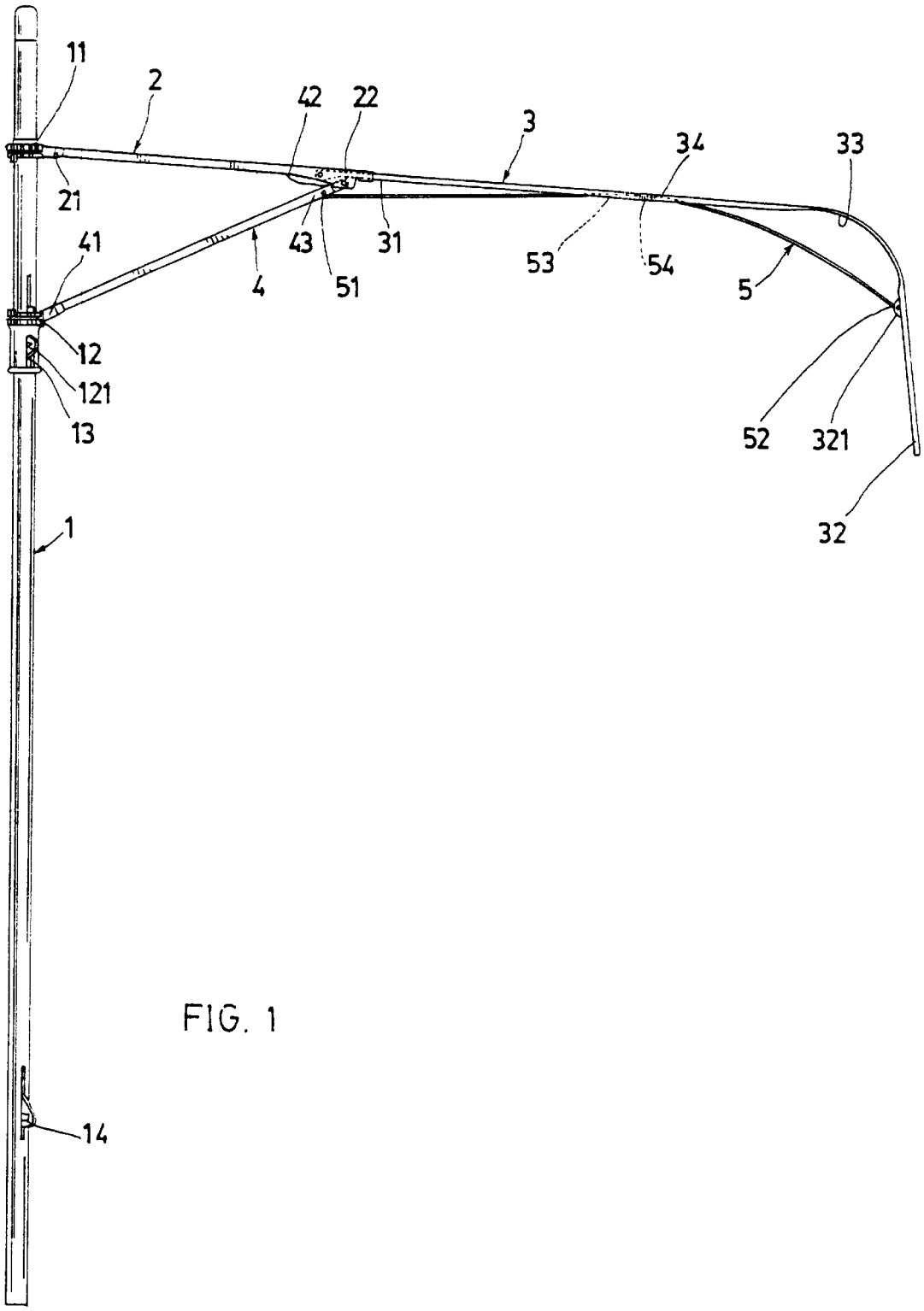
FIG. 1 is an illustration showing an opened umbrella of the present invention.

As shown in the drawing figures, the present invention comprises: a central shaft 1 having an upper notch 11 formed on a top portion of the shaft 1 and a runner or lower runner 12 slidably held on the shaft 1, a top rib 2 pivotally secured to the upper notch 11 of the shaft 1, an outer rib 3 connected to the top rib 2 and radially protruding outwardly from the top rib 2, a stretcher rib 4 pivotally connected between the lower runner 12 and the top rib 2, and a pulling rib 5 pivotally connected between the stretcher rib 4 and the outer rib 3. An umbrella cloth (not shown) is provided to cover the rib assembly including the ribs 2, 3.

The top rib 2 has a cross section of U shape and may be made of light materials including: aluminum alloy, titanium alloy, and other light materials.

The top rib 2 includes an inner portion 21 pivotally secured to the upper notch 11 and an outer portion 22 for fixing the outer rib 3 and for pivotally connecting the stretcher rib 4.

The outer rib 3 has a cross section of U shape and may be made of steel or other suitable materials having proper mechanical strength and resilience.

The stretcher rib 4 may also have a cross section of U shape and may be made of light materials including aluminum alloy, titanium alloy and other light materials.

The pulling rib 5 may be a spring rod or wire having a cross section of circular shape or other shapes, not limited in the present invention. The spring rod for making the pulling rib 5 may be made of steel, or other suitable materials having proper resilience.

The outer portion 22 of the top rib 2 includes: an outermost end portion 221 crimped for clamping an inner portion 31 of the outer rib 3, a connecting portion 222 formed on an outer end portion of the top rib 2 for fixing an innermost end portion 311 of the outer rib 3 such as by riveting or other joining methods, and a pair of lugs 223 protruding downwardly from the top rib 2 to be pivotally connected with an outermost end portion 42 of the stretcher rib 4 of which the inner portion 41 is pivotally secured to the lower runner 12, with each lug 223 tapered upwardly inwardly towards the top rib 2 by a reinforcing wing portion 224 between the lug 223 and the top rib 2 for reinforcing the strength of the outer portion 22 of the top rib 2.

The outer portion 22 of the top rib 2 may also be further connected with a joint member for respectively connecting the outer rib 3 and the stretcher rib 4 with the top rib 2.

Figure 4:
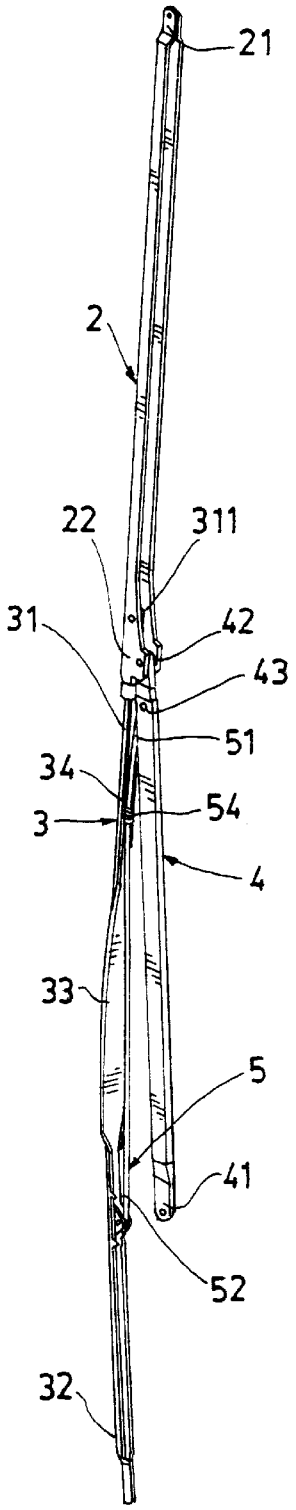
FIG. 4 is a perspective view of the rib assembly of the present invention.
Figure 5:
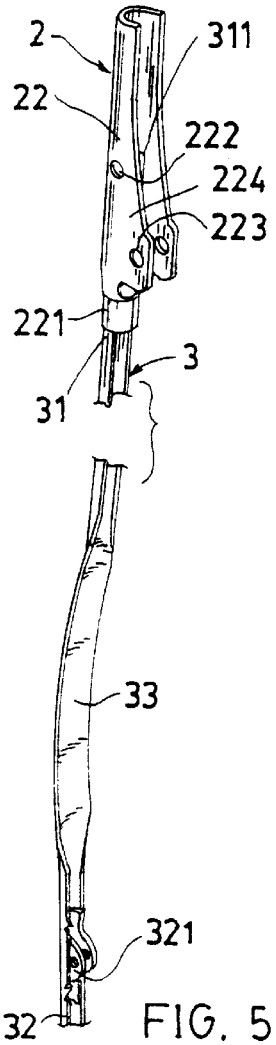
FIG. 5 is a perspective view of the partial rib assembly of the present invention.
Figure 6:
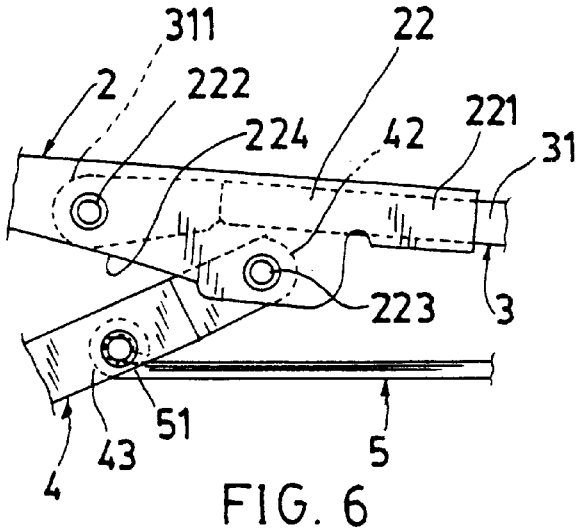
FIG. 6 shows a joining of the top rib, the outer rib and the stretcher rib the present invention.

The outer rib 3 includes: an inner portion 31 secured to the outer portion 22 of the top rib 2, an outer portion 32 for securing an outer skirt portion of the umbrella cloth (not shown) thereon, and a flattened portion 33 pressed or formed to be a flat plate portion as diverged from the outer rib 3 having a cross section of U shape (especially as shown in FIGS. 4, 5) for exerting a resilience on the flattened portion of the outer rib 3 when pulled inwardly as shown in FIG. 1 by the pulling rib 5 and stretcher rib 4 when opening the umbrella.

The pulling rib 5 includes: an inner end 51 pivotally connected with an outer portion 43 of the stretcher rib 4, and an outer end 52 pivotally secured to a lug portion (or a pair of lugs) 321 formed on the outer portion 32 of the outer rib 3.

The pulling rib 5 has a middle portion 53 slidably held in a ring member 54 retained in a crimped portion 34 as crimped inwardly on a middle portion of the outer rib 3.

Figure 7:
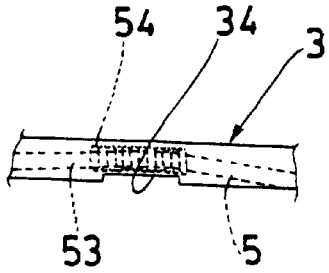
FIG. 7 shows the coupling of the pulling rib with the outer rib of the present invention.
Figure 8:
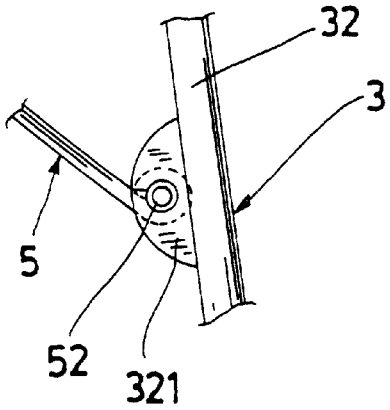
FIG. 8 shows the connection of the pulling rib with the outer rib of the present invention.

The ring member 54 may be a collar, or a helical spring coil as shown in FIG. 7, but not limited in the present invention.

Figure 2:
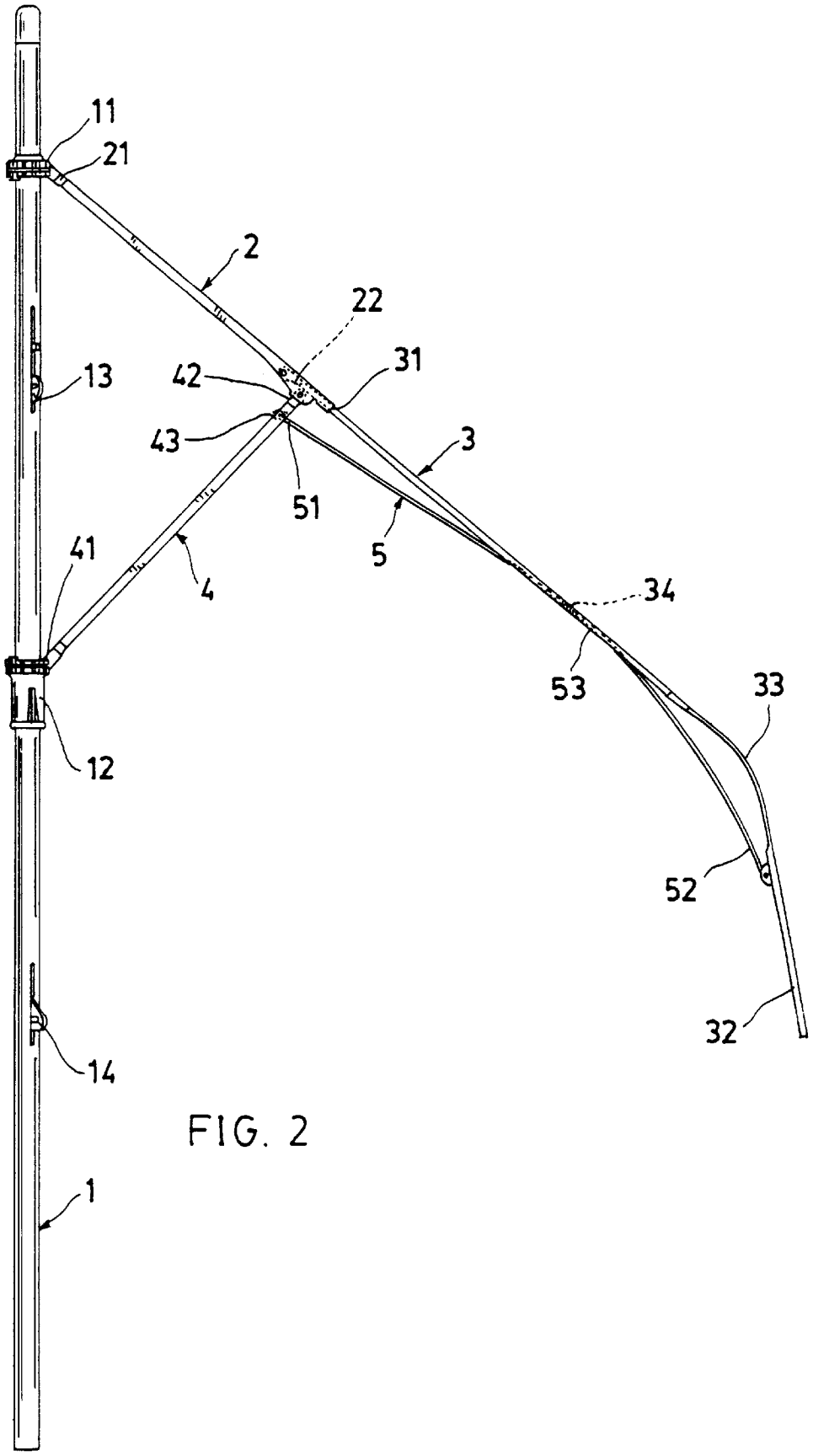
FIG. 2 shows an umbrella being folded from FIG. 1 in accordance with the present invention.
Figure 3:
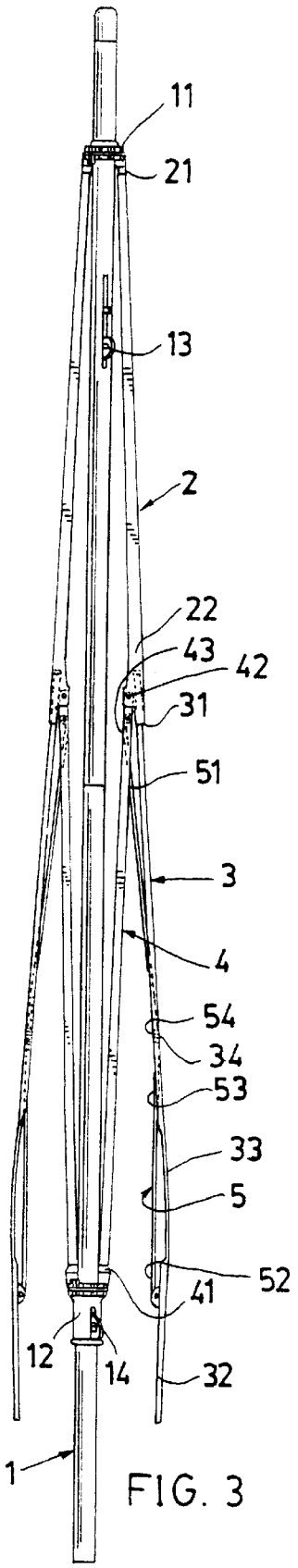
FIG. 3 shows a folded umbrella from FIG. 2.

When opening the present invention as shown in FIG. 1 from a closed state of FIG. 3 and an intermediate unfolded state of FIG. 2, the runner 12 is raised to upwardly move the stretcher rib 4 to drag the pulling rib 5, thereby extending the top rib and the outer rib 3 and allowing the pulling rib 5 to pull the outer portion 32 of the outer rib 3 downwardly inwardly to be generally perpendicular to the outer rib 3 and top rib 2 which are generally straightened horizontally as shown in FIG. 1 until the runner 12 is locked on the shaft 1 by engaging an upper catch 13 resiliently protruding from the shaft 1 with a slot 121 notched in the runner 12.

The skirt portion of the umbrella cloth may then be covered on the bent outer portion 32 of the outer rib 3; while the top rib 2 and the outer rib 3 will be horizontally positioned to support the central portion (canopy) of the umbrella cloth. Since the umbrella canopy has become flat, not a dome-like structure, it will resist a side-blowing wind to thereby prevent from inversion of an opened umbrella. Also, the top flat umbrella may be provided for decorative or advertising uses.

When closing the umbrella from FIG. 1 to FIG. 2, 3, the runner 12 is lowered to release the pulling rib 5 and the bent outer portion 32 of the outer rib 3 until the runner 12 is locked on the lower catch 14 resiliently held in the shaft 1. The resilience of the pulling rib 5 and the outer rib 3 will help restore and straighten the outer rib 3 and the pulling rib 5 to approach the central shaft 1 to form a compact folded umbrella.

The present invention is superior to a conventional flat top umbrella with the following advantages:

1. The elements and ribs have been minimized to form a simple flat top umbrella with easier operation and decreased production cost.
2. The top rib 2 and the stretcher rib 4 are made of light materials such as aluminum alloy for a convenient carrying purpose.
3. The flattened portion 33 of the outer rib 3 will furnish the flexibility and resilience of the outer rib for smoothly enhancing the unfolding and folding operation of the present invention, also for minimizing a folded volume when closing the umbrella.
4. The pulling rib 5 is approximately retained to the outer rib 3 to provide a larger "space" under the canopy better for the operation of the umbrella user. The flattened portion 33 after being bent when opening the umbrella will have a smooth contact with the umbrella cloth, without pricking or damaging the umbrella cloth.

The present invention may be modified without departing from the spirit and scope as claimed in this invention. For instance, the present invention may be modified to be an automatic umbrella after implementing a tensioning (opening) spring on the central shaft.

What is claimed is:

1. A flat top umbrella comprising:

a central shaft (1) having an upper notch (11) formed on a top of the shaft and a lower runner (12) slidably held on said shaft;

a top rib (2) pivotally secured to the upper notch (11);

an outer rib (3) fixed to the top rib (2) and radially protruding outwardly from the top rib (2) adapted for retaining an umbrella cloth on said top rib (2) and said outer rib (3) and for retaining a skirt portion of the umbrella cloth on an outer portion (32) of said outer rib (3);

a stretcher rib (4) pivotally connected between said top rib (2) and said lower runner (12);

and a pulling rib (5) juxtapositioned to said outer rib (3); said outer rib (3) including: an inner portion (31) secured to an outer portion (22) of the top rib (2), said outer portion (32) for securing the outer skirt portion of the umbrella cloth thereon and for connecting the pulling rib (5), and a flattened portion (33) formed adjacent to the outer portion (32) as a flat plate portion as diverged from the outer rib (3) having a cross section of U shape for exerting a resilience on the flattened portion (33) of the outer rib (3) when pulled inwardly by the pulling rib (5) and stretcher rib (4) when opening the umbrella; said pulling rib (5) including: an inner end (51) pivotally connected with an outer portion (43) of the stretcher rib (4), and an outer end (52) pivotally secured to a lug portion (321) formed on the outer portion (32) of the outer rib (3); and said pulling rib (5) operatively pulling said outer portion (32) of said outer rib (3) inwardly downwardly to be generally perpendicular to the outer rib (3) and the top rib (2) which are horizontally lifted when opening the umbrella, whereby the skirt portion of said umbrella cloth is bent inwardly downwardly.

2. A flat top umbrella according to claim 1, wherein said top rib (2) has a cross section of U shape and is made of light materials including: aluminum alloy, titanium alloy, and the light materials.

3. A flat top umbrella according to claim 1, wherein said outer rib (3) has a cross section of U shape and is made of steel and materials having good mechanical strength and resilience.

4. A flat top umbrella according to claim 1, wherein said stretcher rib (4) has a cross section of U shape and is made of light materials including aluminum alloy, titanium alloy and the light materials.

5. A flat top umbrella according to claim 1, wherein said pulling rib (5) is a spring rod.

6. A flat top umbrella according to claim 1, wherein said top rib (2) has an outer portion (22) including: an outermost end portion (221) crimped for clamping an inner portion (31) of the outer rib (3), a connecting portion (222) formed on an outer end portion of the top rib (2) for fixing an innermost end portion (311) of the outer rib (3), and a pair of lugs (223) protruding downwardly from the top rib (2) to be pivotally connected with an outermost end portion (42) of the stretcher rib (4), with each said lug (223) tapered upwardly inwardly towards the top rib (2) by a reinforcing wing portion (224) between the lug (223) and the top rib (2) for reinforcing the strength of the outer portion (22) of the top rib (2).

7. A flat top umbrella according to claim 1, wherein said pulling rib (5) has a middle portion (53) slidably held in a ring member (54) retained in a middle portion of the outer rib (3).

8. A flat top umbrella according to claim 7, wherein said ring member (54) is a helical spring coil retained in a crimped portion of the outer rib (3).

* * * * *